US012150598B2

(12) United States Patent
Gordon et al.

(10) Patent No.: US 12,150,598 B2
(45) Date of Patent: Nov. 26, 2024

(54) DISPENSING DEVICE WITH REPLACEABLE FRONT COVER

(71) Applicant: Kimberly-Clark Worldwide, Inc., Neenah, WI (US)

(72) Inventors: Alice Susan Gordon, Wilson, NC (US); Eric M. Chalko, Alpharetta, GA (US); Phillip L. Hutchison, Lebanon, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 247 days.

(21) Appl. No.: 17/768,545

(22) PCT Filed: Oct. 31, 2019

(86) PCT No.: PCT/US2019/059000
§ 371 (c)(1),
(2) Date: Apr. 13, 2022

(87) PCT Pub. No.: WO2021/086359
PCT Pub. Date: May 6, 2021

(65) Prior Publication Data

US 2023/0148803 A1 May 18, 2023

(51) Int. Cl.
*A47K 10/36* (2006.01)
*A47K 10/32* (2006.01)
*A47K 10/38* (2006.01)

(52) U.S. Cl.
CPC ..... *A47K 10/3625* (2013.01); *A47K 10/36* (2013.01); *A47K 10/38* (2013.01);
(Continued)

(58) Field of Classification Search
None
See application file for complete search history.

(56) References Cited

U.S. PATENT DOCUMENTS 2,930,664 A * 3/1960 Liebisch ..... A47K 10/3656 242/564.2
3,902,637 A * 9/1975 Scheeler ..... A47K 5/1214 222/511

(Continued)

FOREIGN PATENT DOCUMENTS

CN 2540118 Y 3/2003
CN 201384453 Y 1/2010

(Continued)

OTHER PUBLICATIONS

Alibaba, Billboard Clamp Facial Tissue Dispenser—Buy Facial Tissue Dispenser,Plastic Tissue Dispenser,Facial Tissue Dispenser Product on Alibaba.com, https://www.alibaba.com/product-detail/Billboard-clamp-facial-tissue-dispenser_686500477.html, 4 pages.

(Continued)

*Primary Examiner* — Timothy R Waggoner
(74) *Attorney, Agent, or Firm* — Dority & Manning, P.A.

(57) ABSTRACT

A dispenser for sheet materials is disclosed. The dispenser includes a front plate assembly that allows for easy removal and replacement of the front plate for changing design elements and/or functionality. In one embodiment, the front plate is removably attachable to a back frame member and forms a flush fit with the back frame member when attached. The front plate can be disengaged from the back frame member by opening the dispenser housing and accessing push pins from an interior surface.

19 Claims, 8 Drawing Sheets

(52) U.S. Cl.
CPC ..... *A47K 2010/3233* (2013.01); *A47K 2010/3246* (2013.01); *A47K 2010/389* (2013.01)

(56) References Cited

U.S. PATENT DOCUMENTS

| | | | | |
|---|---|---|---|---|
| 4,487,375 | A | 12/1984 | Rasmussen et al. | |
| 4,915,316 | A * | 4/1990 | Bastian | A47K 10/40 242/596.8 |
| 5,261,557 | A * | 11/1993 | Bytell | A47K 10/34 40/606.03 |
| 6,170,698 | B1 | 1/2001 | Phelps et al. | |
| 7,426,695 | B1 * | 9/2008 | Massaro | G06F 1/181 715/765 |
| 7,490,733 | B2 | 2/2009 | Tagliareni | |
| 9,067,754 | B2 | 6/2015 | Petersen et al. | |
| 9,858,748 | B2 * | 1/2018 | Thompson | A63F 13/25 |
| 10,136,768 | B2 | 11/2018 | Arlemark et al. | |
| 10,321,792 | B2 | 6/2019 | Kennedy | |
| 2003/0067254 | A1 * | 4/2003 | Manke | A47L 15/4265 312/265.6 |
| 2005/0223486 | A1 | 10/2005 | Jumalon | |
| 2006/0202641 | A1 | 9/2006 | Buij et al. | |
| 2007/0119858 | A1 | 5/2007 | Ayoub | |
| 2008/0203870 | A1 | 8/2008 | Riley et al. | |
| 2009/0120950 | A1 | 5/2009 | Titas et al. | |
| 2015/0101954 | A1 | 4/2015 | Pierson Jones | |
| 2016/0256021 | A1 | 9/2016 | Jolin et al. | |
| 2016/0373844 | A1 * | 12/2016 | Owens | H04R 1/028 |
| 2018/0028027 | A1 * | 2/2018 | Kendall | F21V 23/0464 |
| 2018/0132676 | A1 * | 5/2018 | Thomas | G06Q 90/00 |
| 2018/0353017 | A1 * | 12/2018 | Miranda | A61L 2/10 |
| 2023/0251024 | A1 * | 8/2023 | Wang | F25D 23/02 |

FOREIGN PATENT DOCUMENTS

| | | | |
|---|---|---|---|
| CN | 201384454 | Y | 1/2010 |
| DE | 4315097 | A1 | 11/1993 |
| KR | 101105553 | B1 | 1/2012 |
| KR | 200473764 | Y | 1/2014 |
| TW | M332408 | U | 5/2008 |
| WO | WO2011044224 | A2 | 4/2011 |
| WO | WO2014185843 | A1 | 11/2014 |

OTHER PUBLICATIONS

Brazilian Office Action Corresponding to Application No. BR112022007830-7 on Sep. 5, 2023.

European Search Report Corresponding to Application No. 19950233.7 on Jun. 20, 2023.

Surefresh, Surefresh Wet Tissue Dispenser—Touch Display, https://www.amazon.in/Surefresh-Wet-Tissue-Dispenser-Display/dp/B01BM5GG72, 2 pages.

International Search Report for PCT/US2019/059000 dated Jul. 29, 2020, 2 pages.

CN Office Action Corresponding to Application No. 201980101850.1 on May 26, 2023.

US Office Action Corresponding to U.S. Appl. No. 17/771,399 on Apr. 11, 2024.

* cited by examiner

DISPENSING DEVICE WITH REPLACEABLE FRONT COVER

RELATED APPLICATIONS

The present application is based upon and claims priority to PCT International Patent Application No. PCT/US2019/059000, filed on Oct. 31, 2019, which is incorporated herein by reference.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. Currently, janitors or maintenance personnel roam the buildings in which they are working to service the washrooms, or the janitors or maintenance personnel are sent to service a particular washroom or dispenser after a problem has occurred. Fixing of a problem with the washroom after the fact results in numerous tenant complaints and overall dissatisfaction. Additionally, janitorial or maintenance personnel resources are focused on servicing emergencies and are pulled away from other tasks. Additionally, waste of product is high since janitors or maintenance personnel tend to change out products before the dispensers are empty in order to avoid running out of the products before the janitors or maintenance personnel return to once again service the dispensers.

In view of the above, those skilled in the art have spent considerable time designing smart dispensers that are intended to overcome the problems noted above. For instance, dispensers have been designed that can monitor product usage and product levels in order to prevent waste. In addition, electronic towel dispensers have been designed that automatically dispense a metered length of towel material upon sensing the presence of a user. This type of dispenser has become known in the art as a "hands-free" dispenser in that it is not necessary for the user to manually activate or otherwise handle the dispenser to initiate a dispense cycle. The control systems and mechanical aspects of hands-free dispensers are wide and varied.

Problems still remain, however, in incorporating different functionalities into a standard dispenser. For example, the capability of modifying a dispenser for a particular application and/or for a particular customer is limited. For example, a need exists for a system and method for modifying an existing dispenser so that the dispenser will have an appearance desired by an end user and/or a functionality desired by an end user.

In the past, for instance, design modifications to existing dispensers have been somewhat rudimentary. For example, U.S. Pat. No. 10,136,768 is directed to a dispenser with a metal sheet outer surface support structure. In the '768 patent, an outer cover having a desired appearance is simply snapped on to the outside of the housing.

In view of the above, a need exists for a dispenser design that allows for more improved dispenser design control and/or for incorporating different functionality into a dispenser.

SUMMARY

In general, the present disclosure is directed to a dispenser for a sheet material, such as paper towels, that has a modular front plate design that can be installed optionally at the end-user level. The modular dispenser front plate design, for instance, can be modified only by access to the interior of the housing of the dispenser and can have a variety of different external materials/aesthetics. In one embodiment, the modular dispenser front plate design can be used to integrate different electronic hardware into the dispenser for enabling greater functionality depending upon customer desires.

In one embodiment, for instance, the present disclosure is directed to a dispenser for sheet material, such as paper towels, bath tissue, and the like. The dispenser includes a housing having an interior volume so as to retain at least one roll of sheet material, such as two rolls of sheet material. The dispenser further includes a dispensing mechanism contained within the housing for dispensing the sheet material.

In accordance with the present disclosure, the housing includes a front cover assembly. The front cover assembly includes a front plate having a first side and a second and opposite side. The first side of the front plate forms an exterior surface of the dispenser. The front cover assembly further includes a back frame member. The back frame member includes a first side and an opposite second side. The second side forms an interior surface of the housing. The first side defines a raised margin area. The first side of the back frame member is removably attachable to the second side of the front plate. For example, the second side of the front plate can include at least one locking element, such as at least two locking elements, such as at least four locking elements, such as at least six locking elements that correspond in location and connect to a corresponding number of mating receptors on the first side of the back frame member. When the front plate is attached to the back frame member, the front plate forms a flush fit with the margin area of the back frame member. In this manner, the raised margin area of the back frame member forms a portion of the exterior surface of the dispenser. In one embodiment, the margin area surrounds at least three sides of the front plate.

In one embodiment, the front cover assembly can be designed so that the front plate can only be removed and/or installed on the back frame member from the interior of the housing. For example, in one embodiment, the back frame member can include at least one push pin, such as a pair of push pins, located on the second side of the back frame member. The push pins are for separating the front plate from the back frame member when pressure is applied to the push pins for facilitating disengagement of the front plate from the back frame member. For instance, the push pins can push the front plate beyond the margin area of the back frame member allowing for a user to slide the front plate off and out of engagement with the back frame member.

The locking elements located on the second side of the front plate and the corresponding mating receptors located on the first side of the back frame member can have any suitable interlocking design that allows for engagement and disengagement between the two components. In one embodiment, for instance, each locking element on the second side of the front plate defines a slot and the mating receptors on the first side of the back frame member include a locking tab that is slideably engageable with the slots on the locking element.

In one embodiment, the dispenser can include a power source and the front plate assembly can be configured such that the front plate is connected to the power source when engaged with the back frame member. For example, the locking element and the mating receptors may provide a mechanical connection in addition to an electrical connection. Alternatively, an electrical connection between the front plate and the power source can occur independently from the locking elements. By making an electrical connection, the front plate can have enhanced functionality. For example, in one embodiment, the front plate can comprise an electronic display. The front plate can also include an audio speaker.

In addition to functionality, the front plate can also be designed for aesthetic appeal. For instance, the first side can have a mirrored finish, a metallic finish, a woodgrain finish, a decorative pattern, or can display trademarks, a company name, or other information desired by the end user. In one embodiment, the present disclosure can be directed to a dispenser assembly that includes a plurality of different front plates that the end user can install as desired.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIGS. 2 through 5 illustrate one embodiment of a front plate assembly in accordance with the present disclosure wherein FIG. 2 is a plan view of one embodiment of a front plate;

FIG. 3 is a plan view of one embodiment of the back face of the front plate illustrated in FIG. 2;

FIG. 4 is a plan view of one side of a back frame member in accordance with the present disclosure;

FIG. 5 is a plan view of the opposite side of the back frame member illustrated in FIG. 4;

Figure 1:
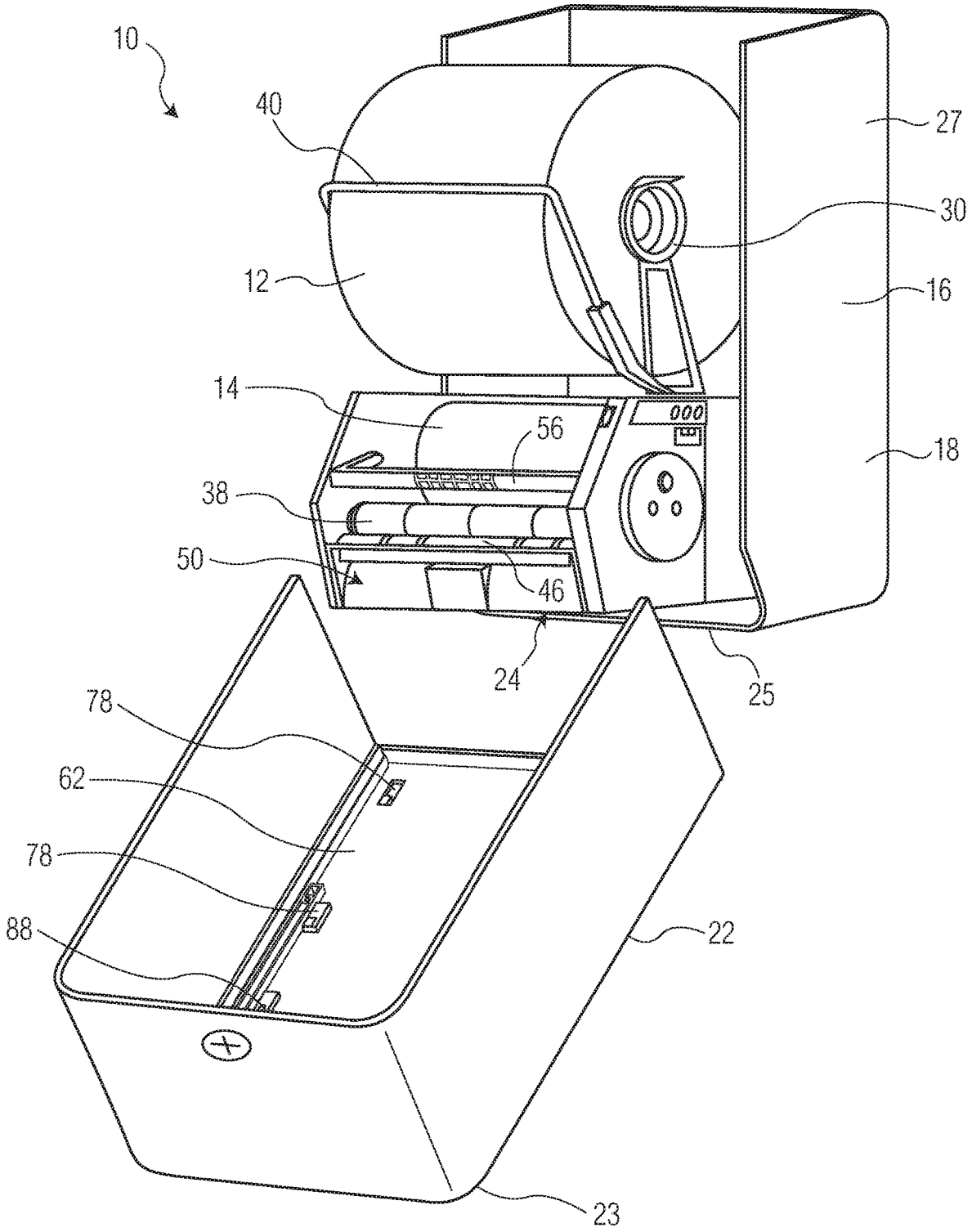
FIG. 1 is a perspective view of one embodiment of a dispenser in accordance with the present disclosure with its front cover in an open position.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for sheet materials and/or to a dispenser assembly. The dispenser of the present disclosure allows for flexibility in design offerings and functionality without having to change the entire dispenser system. More particularly, the present disclosure is directed to a dispenser for sheet materials with a modular dispenser front plate design that can be installed at the end-user level. In accordance with the present disclosure, the dispenser is configured to include an exchangeable front plate that can change the aesthetic appeal and/or functionality of the dispenser. For instance, the dispenser includes a front plate that forms the front face and external surface of the dispenser which can be easily switched out and replaced. For example, a user can select a front plate that has a particular desired look and/or can install a front plate that can include electronic hardware that can enable various tiered functionality, such as lighting and connectivity.

In one embodiment, the dispenser includes at least a two-part housing having a front cover and a back cover. The front cover can be pivotably connected to the back cover for opening and closing the housing. The front plate assembly of the present disclosure can be integrated into the front of the housing and can be designed such that the front plate can only be removed and replaced by having access to the interior of the housing.

Figure 6:
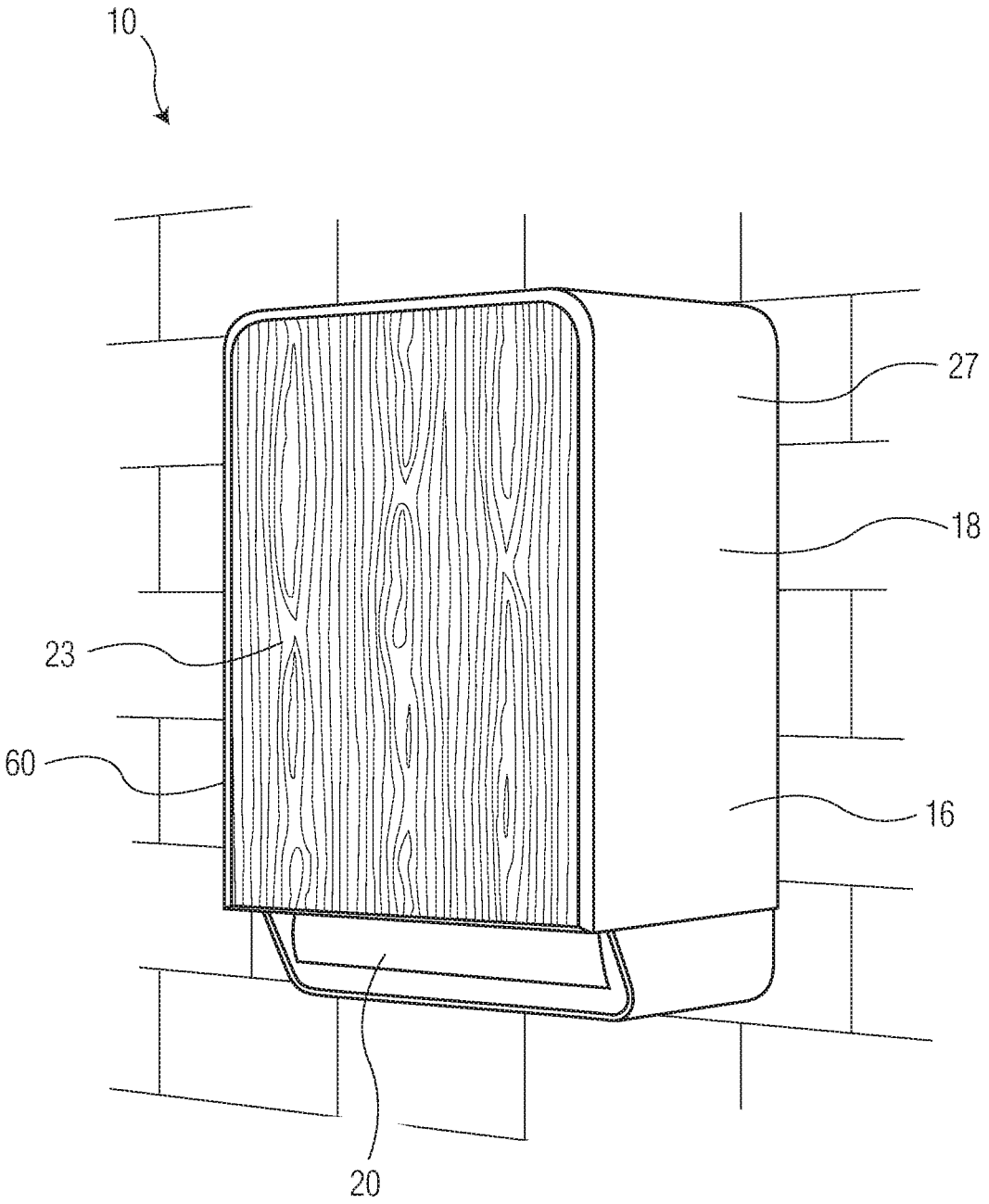
FIG. 6 is a perspective view of one embodiment of a dispenser made in accordance with the present disclosure.
Figure 7:
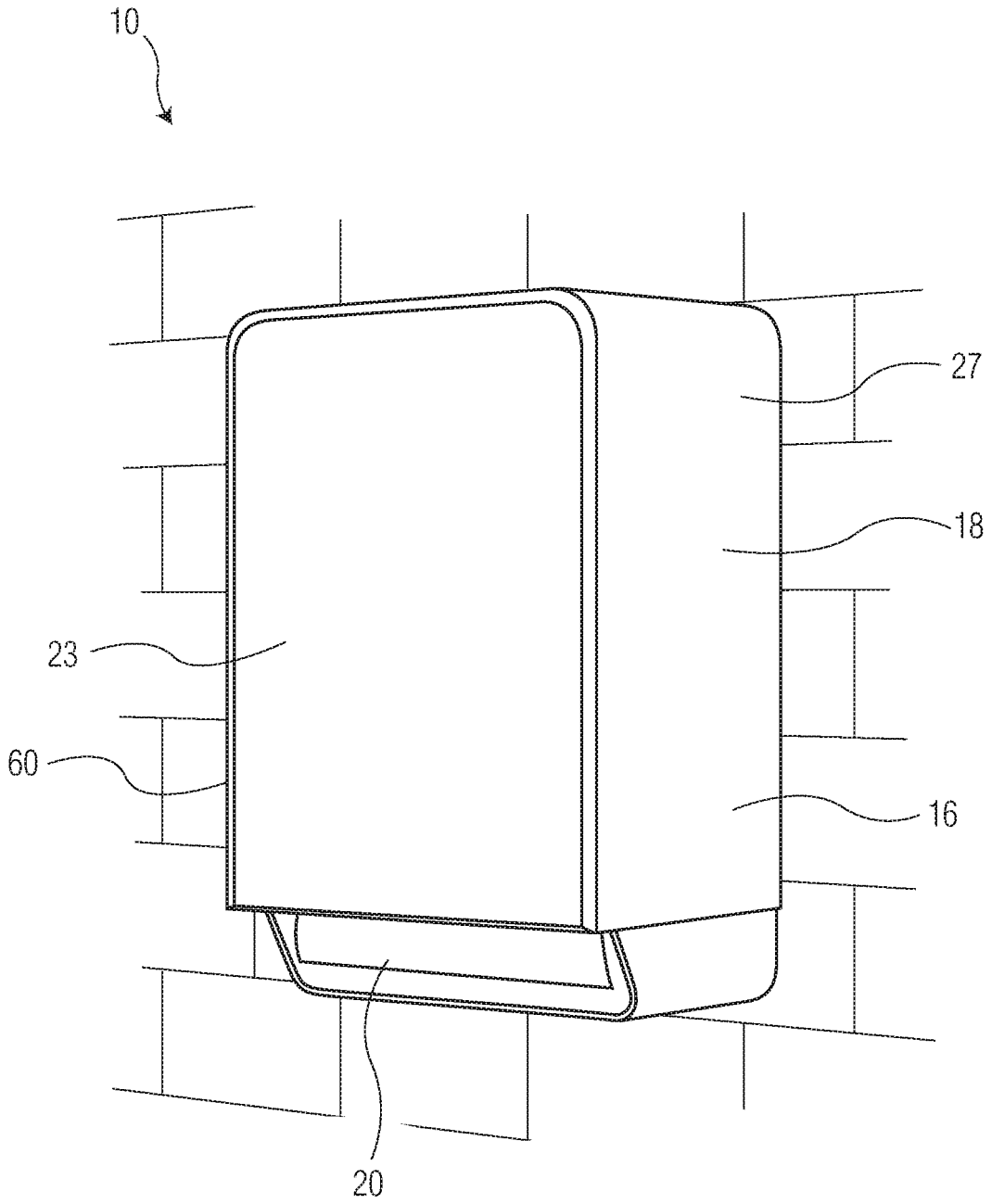
FIG. 7 is a perspective view of another embodiment of a dispenser in accordance with the present disclosure.
Figure 8:
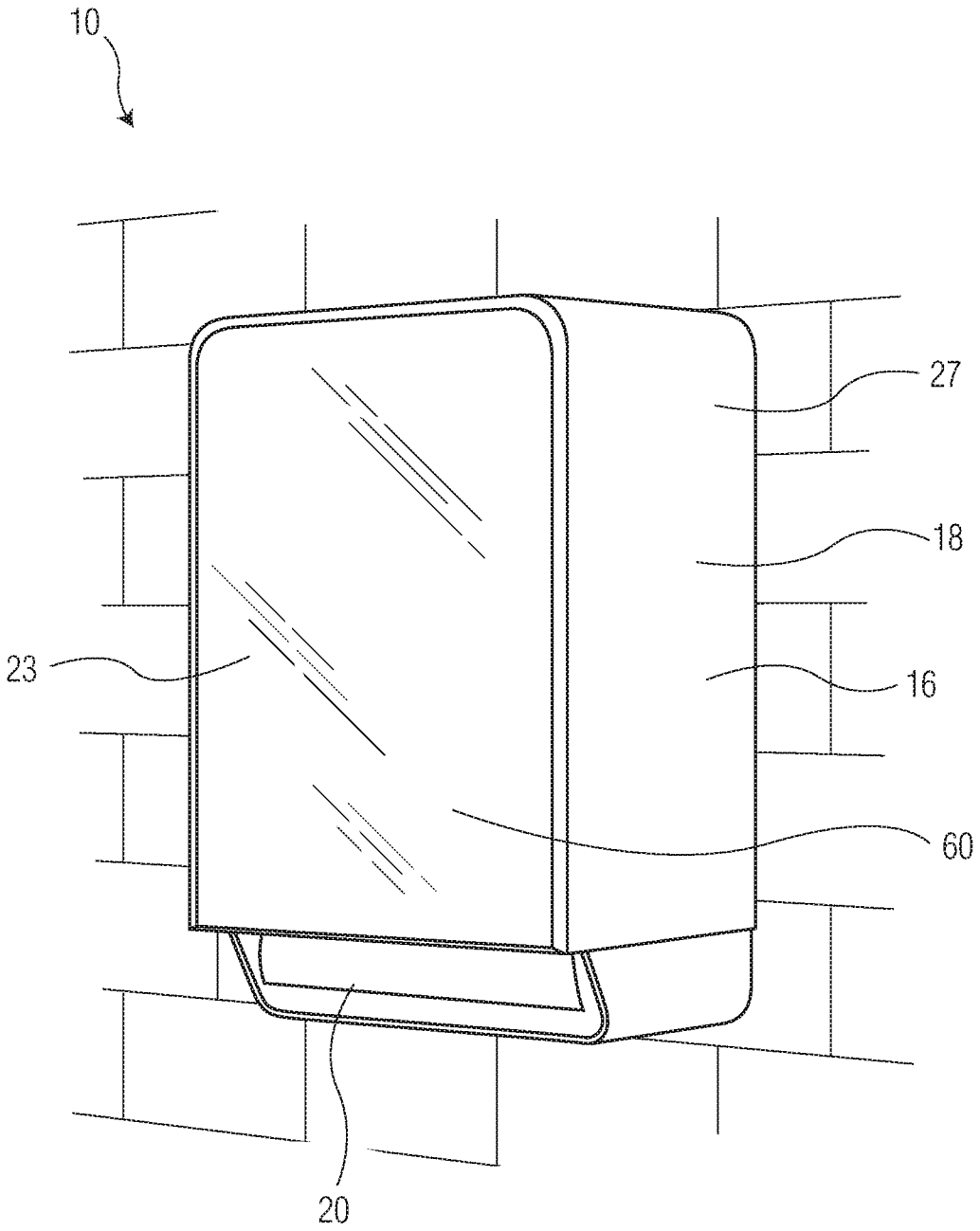
FIG. 8 is a perspective view of another embodiment of a dispenser in accordance with the present disclosure.

Referring particularly to FIGS. 1 and 6-8, various embodiments of a dispenser 10 made according to the present disclosure are illustrated. As shown particularly in FIG. 1, the dispenser 10 includes a housing 16 that can have any desired overall shape. The housing 16 can include a two-part configuration. For example, the housing can include a back cover 18 and a front cover 22. The front cover 22 can be pivotally mounted to the back cover 18 using any suitable means. For example, in one embodiment, hinges can be used to connect the front cover 22 with the back cover 18. Alternatively, the front cover 22 can be completely separable from the back cover 18. The front cover 22 is moveable from a closed position as shown in FIGS. 6-8 to an open position as shown in FIG. 1. The front cover 22 defines a front face 23 while the back cover 18 defines side walls 27. In the embodiment illustrated, the side walls are entirely defined by the back cover 18. In other embodiments, however, the front cover 22 may have side walls that cooperate with the side walls of the back cover 18. The housing 16 defines an interior volume for housing the operational components of the dispenser 10, as well as the roll or rolls of sheet material to be dispensed, including a main roll 12 and a stub roll 14. The dispenser 10 can also include any conventional locking mechanism 21 for securing the front cover 22 to the back cover 18. The housing 16 further includes an opening 20 through which a sheet material is dispensed.

The dispenser configuration 10 illustrated in the figures is merely exemplary for any number of dispenser configurations known to those skilled in the art that may incorporate the front plate assembly of the present disclosure. As such, a detailed explanation of the structural and control features of the dispenser 10 are not necessary for purposes of explanation of the system and method of the present disclosure, and will only be discussed briefly below.

The operational components of the dispenser 10 may be mounted directly to the back cover 18 or can be part of a module that is received within the housing 16. For example, the operational components can be part of a module that may be readily removable from the housing for servicing and/or replacing components without the necessity of having to remove the entire dispenser 10 from its support surface.

As shown in FIG. 1, the operational components can include a pressure roller 46, a transfer mechanism that may include a transfer arm 56, a throat assembly 50 that defines a throat 24, a drive motor and gear assembly that rotates a drive roller 38, and control circuitry which may include a controller or microprocessor.

Left and right main roll holders 30 are attached within the housing and hold the main roll 12 of sheet material. Stub roll holders may be provided for rotatably supporting the stub roll 14 in the position within the housing below the main roll 12. It should be understood that a dispenser according to the present disclosure need not be configured to dispense from a stub roll, and thus would not need a transfer mechanism. The dispenser may be configured for dispensing from a single roll of sheet material.

The pressure roller 46 may be housed within the throat assembly 50 that is, in turn, mounted within the housing. The dispenser 10 may also include a tear bar or cutting bar that is contained within the throat assembly 50 and disposed along the dispensing path of the sheet of material upstream from the dispensing opening 20 and downstream of the nip between the drive roller 38 and the pressure roller 46. To separate a sheet of material that has been dispensed from the dispenser 10, the cutting bar can automatically cut the material or, alternatively, a user can grasp a sheet hanging from beneath a bottom portion of the housing and pulls the sheet against the cutting or tear bar such that the sheet tears and separates along a line defined by the tear or cutting bar.

The pressure roller 46 is spring biased against the drive roller 38 such that the sheet of material passing between the nip of the rollers is advanced along the dispensing path upon rotation of the drive roller 38. The throat assembly 50 defines a portion of the dispensing path and the forward portion of the dispensing throat 24. The dispenser 10 may further include an automatic transfer mechanism to transfer dispensing of the sheet of material from the stub roll 14 to a main roll 12 when the sheet of material on the stub roll 14 is nearly depleted. Any suitable transfer mechanism may be used. For example, the transfer mechanism may include a transfer bar 56 with arms pivotally mounted. The transfer bar 56 includes a roller section that may be defined by a central curved rib section. The rib section includes a securing mechanism, such as a barb, so that the leading end of the sheet of material from the main roll 12 passes over the rib section and is held by the barb while material is fed from the stub roll 14. The dispenser 10 can also include a stub roll sensing device, such as a sensing bar that is biased towards the axis of the stub roll holders so as to track the decreasing diameter of the stub roll as it is depleted. Alternatively, an electronic sensor can also be used to monitor the stub roll.

The dispenser 10 can also include a spring biased bar 40 that is pivotally mounted within the housing 16 and biased towards the center of the main roll 12 such that tracks a decreasing diameter of the main roll 12 as the sheet of material is depleted. Again, instead of a spring biased bar 40, any suitable electronic sensor may also be used. When the main roll 12 reaches a diameter suitable for moving the roll to the stub roll position, the dispenser 10 can include suitable mechanical elements for moving the main roll 12 into place for dispensing the sheet of material.

The drive roller 38 can be placed in communication with a drive motor and gear assembly. The motor can include a drive shaft and a drive gear attached thereto that engages the shaft of the drive roller 38. Thus, upon energizing the motor, the drive roller 38 is caused to rotate, which results in conveyance of the sheet of material disposed in the nip between the pressure roller 36 and the drive roller 38 along the conveying path and out of the dispensing throat 24.

The dispensing mechanism may be powered by batteries contained in a battery compartment or can be powered by an AC distribution system. If the dispenser 10 includes batteries, a sensor can also be included for determining the power level of the batteries.

As described above, the dispenser 10 can include a controller and control circuitry. The controller and control circuitry can control and monitor all the functions of the dispenser 10 including the length of the sheet of material being dispensed, product usage, and any other activities that are occurring within the dispenser. The controller can be configured to communicate information regarding the dispenser 10 to a central control system via wired means or through a web-based system.

In one embodiment, the dispenser 10 can include a sensor that is designed to detect the presence of a user in a detection zone. Once the presence of a user is detected, the dispenser 10 can be configured to automatically dispense the sheet product.

Figure 2:
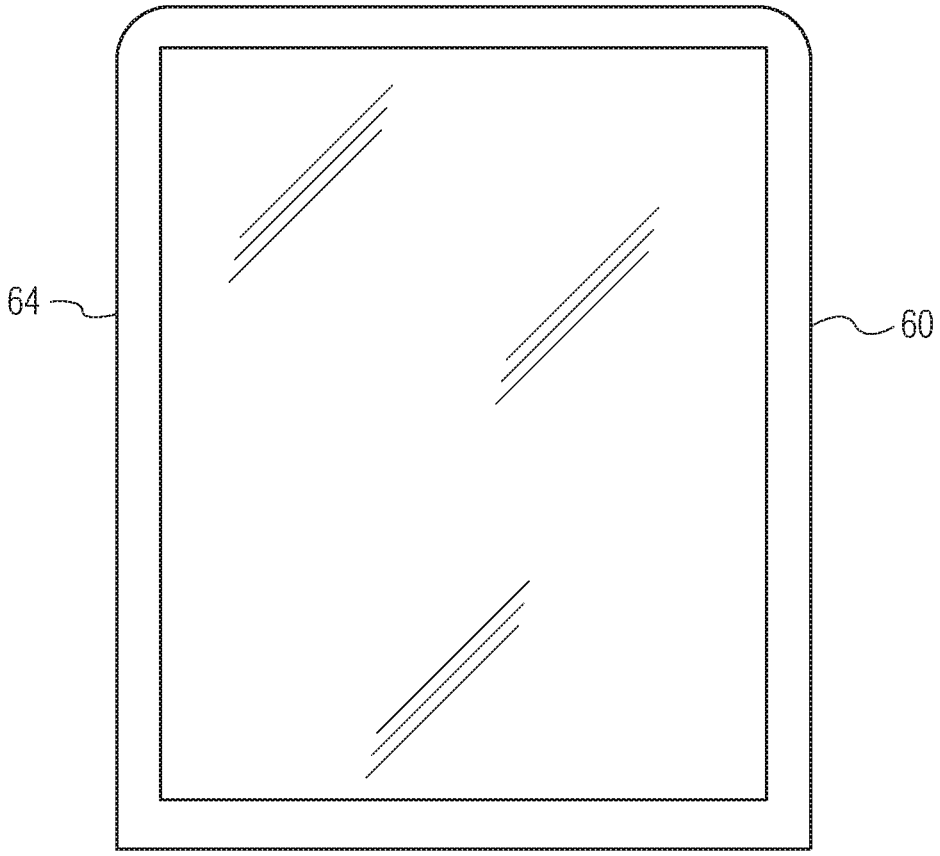
Figure 3:
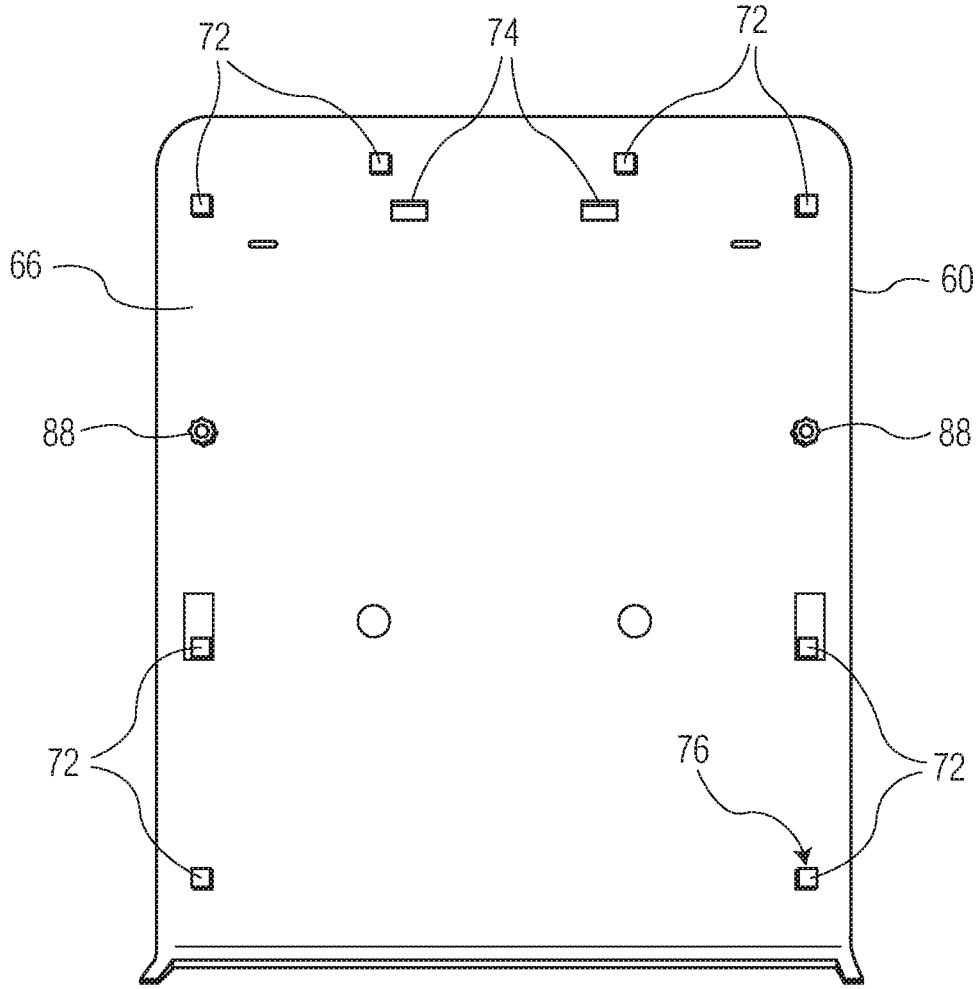
Figure 4:
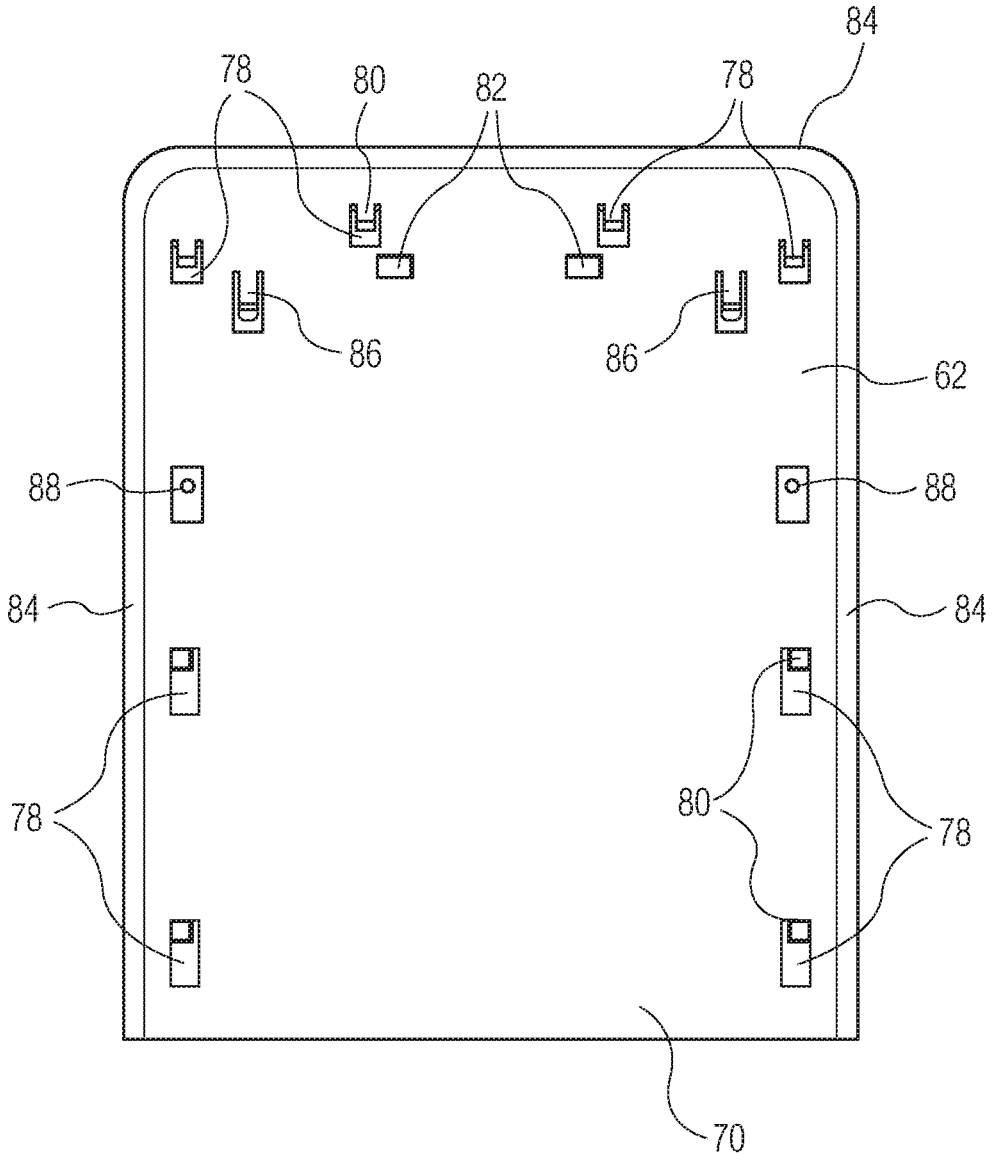
Figure 5:
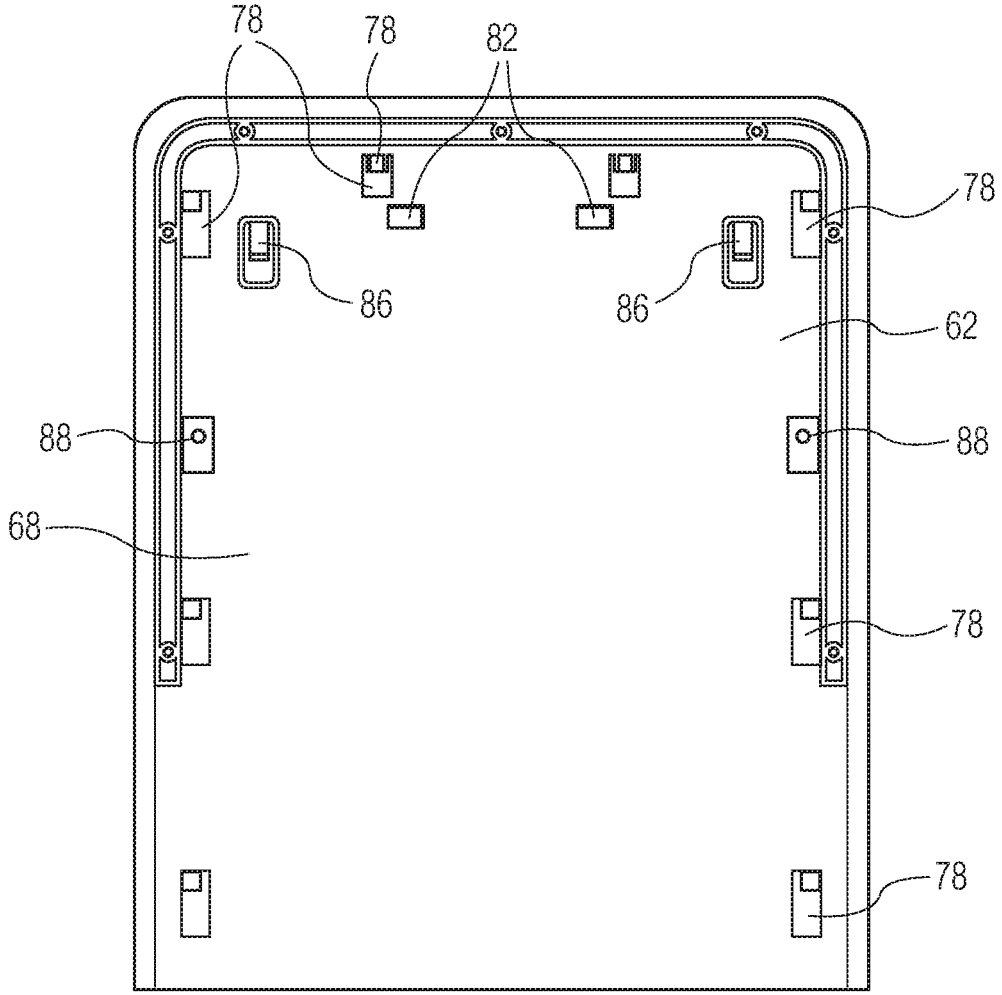

In accordance with the present disclosure, the front cover 22 of the dispenser 10 includes a front plate assembly as shown in FIGS. 2-5. More particularly, the front plate assembly includes a front plate 60 that is removably attachable to a back frame member 62. The front plate 60 is illustrated in FIGS. 2 and 3, while the back frame member 62 is illustrated in FIGS. 4 and 5. The front plate 60 includes a first side 64 and a second and opposite side 66. The front side 64 forms an exterior surface of the housing and, in one embodiment, the front face as shown in FIGS. 6-8. The second side 66 of the front plate 60 is removably attachable to the back frame member 62. For example, the back frame member 62 can include a first side 68 as shown in FIG. 5 and a second and opposite side 70 as shown in FIG. 4. The first side 68 of the back frame member 62 forms an interior surface within the dispenser 10. The second side 70 of the back frame member 62, on the other hand, can releasably attach to the second side 66 of the front plate 60. For example, the second side 66 of the front plate 60 can include a plurality of locking elements 72 and one or more alignment tabs 74. In the embodiment illustrated in FIG. 3, the second side 66 of the front plate 60 includes eight locking elements 72. Each locking element 72 can be the same or different. Further, the front plate 60 may include a single locking element or can include any suitable number of locking elements for a particular application. For instance, the front plate 60 can include anywhere from two to ten locking elements, such as four or greater locking elements, such as six or greater locking elements. As shown in FIG. 3, each locking element 72 defines a locking slot 76.

As shown in FIG. 4, the second side 70 of the back frame member 62 includes a corresponding number of mating receptors 78 that are positioned to receive the locking elements 72. As shown in FIG. 4, in one embodiment, each mating receptor 78 can include a locking tab 80. In this manner, each locking element 72 can be received in an opening defined by the mating receptor 78 and then slid so that the locking tabs 80 engage with the slots 76. It should be understood, however, that the mechanical interlock system as shown in FIGS. 3 and 4 can vary depending upon the particular application and the desired result.

As shown in FIG. 3 and as described above, the front plate 60 includes alignment tabs 74. The alignment tabs 74 are configured to engage with alignment slots 82 on the second side 70 of the back frame member 62. The alignment tabs assist in aligning the front plate 60 with the back frame member 62 when placing the front plate 60 onto the back frame member 62 for engagement therewith.

In one embodiment, as shown in FIG. 4, the second side 70 of the back frame member 62 can include a raised margin area 84. The raised margin area 84 forms an exterior surface on the dispenser 10. For example, when the front plate 60 is slid into engagement with the back frame member 62, the front plate 60 forms a flush fit with the raised margin area 84, which not only improves the aesthetic design of the product but also prevents inadvertent release of the front plate 60 from the back frame member 62. The raised margin area 84 surrounds the perimeter of the front plate 60. In the embodiments illustrated in FIGS. 6-8, for instance, three sides of the front plate 60 are surrounded by the raised margin area 84. The front plate 60, however, can have any suitable shape and may not be rectangular. In this regard, the raised margin area 84 may lay adjacent to greater than about 60%, such as greater than about 70%, such as greater than about 75% of the perimeter of the front plate 60. In an alternative embodiment, the raised margin area 84 surrounds the entire perimeter of the front plate 60.

As shown in FIG. 4, the raised margin area 84 can surround at least three sides of the front plate 60 when the front plate 60 is connected to the back frame member 62.

In order to remove the front plate 60 from the back frame member 62, the back frame member 62 can include one or more push pins 86 as shown in FIG. 5. For example, applying pressure to the push pins 86 can lift the front plate 60 over the raised margin area 84 allowing a user to slide the front plate 60 out of engagement with the back frame member 62. In this manner, the front plate 60 can be easily removed and replaced by the end user. In addition, as described above, in order to remove the front plate 60, one would need to open the dispenser housing 16 in order to access the push pins 86. Having the push pins 86 located on the interior surface of the housing 16 prevents against inadvertent removal of the front plate 60 and allows removal of the front plate 60 only when the housing 16 is unlocked and opened.

In addition to mechanically connecting the front plate 60 to the back frame member 62, the dispenser 10 can also be configured so that the back plate 60 becomes electrically connected to a controller and a power supply within the dispenser 10 when attached to the back frame member 62. For example, in one embodiment, the locking elements 72 and the mating receptors 78 may create an electrical connection in addition to a mechanical connection using appropriate wiring. In an alternative embodiment, the front plate assembly can include electrical conduits 88 that extend from the second side 66 of the front plate 60 as shown in FIG. 3 and through the back frame member 62 as shown in FIGS. 3 and 4. The one or more electrical conduits 88 can receive appropriate wiring for making electrical connections.

In this regard, the front plate 60 can have electronic functionality. As shown in FIG. 2, for instance, the front plate 60 may comprise an electronic display, capable of displaying graphics and images. In addition, the front plate 60 can be equipped with an audio speaker for emitting music, instructions, news, or any other information. In one embodiment, for instance, the front plate 60 can be connected to a controller for displaying television or cable channels, commercials, or any other media content.

In other embodiments, the front plate 60 may be designed to provide an overall look or appearance. For instance, in FIG. 6, the front plate 60 has a woodgrain finish. In FIG. 7, the front plate 60 has a metallic finish. In FIG. 8, on the other hand, the front plate 60 has a mirrored finish. In other embodiments, the front plate 60 can have any desirable color, such as silver, black (onyx), or any color that may match the interior of the room in which the dispenser is located. The front plate 60 can also include trademarks and decorative designs.

In one embodiment, the present disclosure is directed to a dispenser assembly that includes a dispenser as shown in FIG. 1 in combination with a plurality of front plates 60 that each have a different appearance and/or functionality. An end user can then select the front plate to be installed and displayed for a particular purpose or period of time. The end user can also switch out the different front plates as desired.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for sheet materials comprising:

a housing having an interior volume so as to retain at least one roll of sheet material, the housing including a front cover assembly;

a dispensing mechanism contained within the housing for dispensing the sheet material; and wherein the front cover assembly comprises:

(1) a front plate having a first side of the front plate and a second and opposite side of the front plate, the first side of the front plate forming an exterior surface of the dispenser; and (2) a back frame member, the back frame member comprising a first side of the back frame member and a second and opposite side of the back frame member, the second side of the back frame member forming an interior surface of the housing, the first side of the back frame member defining a raised margin area, the first side of the back frame member being removably attachable to the second side of the front plate, wherein the second side of the front plate includes at least one locking element that corresponds in location and connects to at least one mating receptor on the first side of the back frame member and wherein the front plate forms a flush fit with the margin area of the first side of the back frame member when the locking element and mating receptor are engaged, wherein the back frame member includes at least one push pin located on the second side of the back frame member, the push pin for separating the front plate from the back frame member when pressure is applied for facilitating disengagement of the front plate from the back frame member.

2. A dispenser as defined in claim 1, wherein the raised margin area of the first side of the back frame member forms a portion of the exterior surface of the housing.

3. A dispenser as defined in claim 1, wherein the housing includes a front face and wherein the first side of the front plate and the raised margin area of the first side of the back frame member form the front face.

4. A dispenser as defined in claim 1, wherein the second side of the front plate includes at least four locking elements that correspond in location and connect to at least four mating receptors on the first side of the back frame.

5. A dispenser as defined in claim 1, wherein the second side of the front plate includes at least six locking elements that correspond in location and connect to at least six mating receptors on the first side of the back frame.

6. A dispenser as defined in claim 1, wherein the second side of the front plate further includes at least one alignment tab and the first side of the back frame member defines at least one alignment slot for aligning the front plate with the back frame member when connecting the two pieces together.

7. A dispenser as defined in claim 1, wherein the locking element on the second side of the front plate defines a slot and the mating receptor on the first side of the back frame member comprises a locking tab that is slideably engageable with the slot on the locking element.

8. A dispenser as defined in claim 1, wherein the first side of the front plate has a mirrored finish.

9. A dispenser as defined in claim 1, wherein the first side of the front plate has a metallic finish.

10. A dispenser as defined in claim 1, wherein the first side of the front plate has a woodgrain finish.

11. A dispenser as defined in claim 1, wherein the dispenser is connected to a power source and wherein the front plate automatically connects to the power source when connected to the back frame member.

12. A dispenser as defined in claim 11, wherein the first side of the front plate comprises an electronic display.

13. A dispenser as defined in claim 11, wherein the front plate includes an audio speaker.

14. A dispenser as defined in claim 1, wherein the back frame member is pivotally connected to the housing.

15. A dispenser as defined in claim 1, wherein the roll of sheet material comprises a roll of paper towels for dispensing paper towels from the dispenser.

16. A dispenser as defined in claim 1, wherein the interior volume of the housing has a volume so as to retain at least two rolls of sheet material.

17. A dispenser as defined in claim 1, wherein the first side of the front plate has a perimeter and wherein the raised margin area of the first side of the back frame member surrounds at least 70% of the perimeter of the first side of the front plate.

18. A dispenser assembly for dispensing sheet material, the dispenser assembly comprising the dispenser as defined in claim 1 and including a plurality of front plates, each front plate having a first surface with a different appearance, each front plate being removably attachable to the back frame member.

19. A dispenser assembly as defined in claim 18, wherein the dispenser assembly includes at least three different front plates.

* * * * *